United States Patent [19]

Feess et al.

[11] 3,980,426

[45] Sept. 14, 1976

[54] PROCESS FOR PRINTING OR PAD-DYEING CELLULOSE/POLYESTER MIXED FABRICS

[75] Inventors: Erich Feess; Sienling Ong, both of Lorsbach, Taunus; Hans Helmut Steuernagel, Kelkheim, Taunus, all of Germany

[73] Assignee: Hoechst Aktiengesellschaft, Frankfurt am Main, Germany

[22] Filed: Jan. 30, 1975

[21] Appl. No.: 545,534

[30] Foreign Application Priority Data

Feb. 2, 1974 Germany ..... 2405057

[52] U.S. Cl. ..... 8/21 C; 8/1 E; 8/92; 8/173

[51] Int. Cl.[2] ..... D06P 3/82

[58] Field of Search ..... 8/21 C, 92, 173, 1 E

[56] References Cited

UNITED STATES PATENTS

| | | | |
|---|---|---|---|
| 3,097,043 | 7/1963 | Mills | 8/55 |
| 3,097,910 | 7/1963 | Andrew et al. | 8/54.2 |
| 3,150,916 | 9/1964 | Karacsonyi | 8/54 |
| 3,265,461 | 8/1966 | Luetzel et al. | 8/84 |
| 3,767,356 | 10/1973 | Turner | 8/21 C |

OTHER PUBLICATIONS

The Merck Index, 6th Edition, (1952) p. 879.

*Primary Examiner*—Joseph L. Schofer
*Assistant Examiner*—A. L. Clingman
*Attorney, Agent, or Firm*—Curtis, Morris & Safford

[57] ABSTRACT

A process for the pad-dyeing or printing of textile material consisting of cellulose and polyester fibers with fiber-reactive and dispersion dyestuffs which comprises printing or padding the textile material with a printing paste or padding liquor which contains besides the usual printing auxiliaries and the dyestuffs mentioned an alkali salt of the formic acid as well as carriers, levelling and/or dispersing agents, fixing the dyestuffs by dry heat at temperatures above 150°C or by hot steam at temperatures above 140°C, and completing the prints or pad dyeings in usual manner.

2 Claims, No Drawings

PROCESS FOR PRINTING OR PAD-DYEING CELLULOSE/POLYESTER MIXED FABRICS

For the dyeing and printing of fibre mixtures of polyesters and native or regenerated cellulose different processes have already been known. In these processes there have been proposed for example pigmented resins, selected vat dyestuffs which have an affinity to both types of fibres, mixtures of fibre-reactive dyestuffs with dispersion dyestuffs, mixtures of dispersion dyestuffs with direct dyestuffs and finally azo dyestuffs which can also be developed on the fibre, selected mordant dyestuffs and phthalocyanine dyestuffs capable, for example, of forming chromium complexes on the fibre.

Due to the considerable differences in the physical and chemical properties both in the two types of fibres present in these mixtures and in the dyestuffs present in the dyestuff mixtures used on such fibre mixtures, these processes cause a number of problems and difficulties which otherwise do not appear when an individual dyestuff is applied to a homogeneous fibre material.

Thus, for example the conditions in the printing paste or in the dyebath suitable for the fixation of the dyestuff on the cellulose fibre may have detrimental effects on the stability of the dyestuff for the polyester fibre. Furthermore, the conditions may also be favorable for the fixation of the dyestuff on the polyester fibre but they may cause an undesired coloring of the cellulose. Thus, for example, the presence of strongly alkaline substances necessary for binding chemically reactive cellulose dyestuffs, may have a very unfavorable effect on the dispersion dyestuffs in their dispersion at higher temperatures. These unfavorable influences of the alkaline substances can be avoided if the alkali required for the fixation of the reactive cellulose dyestuff is applied onto the material only after fixation of the dispersion dyestuff by impregnation.

However, if fibre mixtures are subsequently treated with alkaline impregnation baths, a soiling of the white bottom can easily occur due to the contamination of the impregnation solution by the dyestuffs which are already on the fibre.

With regard to these difficulties the attempts to dye or to print mixed fabrics of the above-mentioned type involve some undesired limitations as to what is commercially tolerable.

Now a process has been found for the pad-dyeing or printing of textile material of cellulose and polyester fibres with reactive and dispersion dyestuffs, which comprises printing or padding the textile material with a printing paste or padding liquor which contains besides the usual printing auxiliaries and the dyestuffs mentioned an alkali salt of the formic acid as well as carriers, levelling and/or dispersing agents, fixing the dyestuffs by dry heat at temperatures above 150°C or by hot steam at temperatures above 140°C and completing the prints or pad dyeings in usual way.

The printing pastes of padding liquors which are used for this process contain the usual additives such as thickeners, hydrotropic agents such as urea and m-nitro-benzoic acid in the form of the sodium salt. These printing pastes or padding liquors additionally contain an alkali salt of the formic acid and carriers, levelling and/or dispersing agents. These alkali salts of the formic acid, preferably sodium formate are added to the printing paste or padding liquor in amounts of 5 to 50 g, preferably 5 to 30 g, per kg of printing paste or padding liquor.

As carriers are used organic esters, as for example acetylsuccinic acid dialkyl-esters, salicylic acid alkyl esters, methyl-salicyclic acid alkyl esters, benzoic acid phenyl esters or $\beta$-naphthoic acid methyl esters. The term "carrier" in the scope of the present invention implies also compounds as described in German Offenlegungsschrift No. 2,062,287 or in German Patent Specification No. 1,184,730. As particularly favorable substances have proved auxiliary mixtures consisting of oxethylated diphenylol propane and oxethylated fatty alcohols, whereby the degree of exethylation per hydroxyl group is between 2 and 25 units of ethylene oxide (German Offenlegungsschrift No. 2,250,017).

As levelling agents there are considered compounds which can be obtained by esterification of higher molecular polyglycols with carboxylic acids. Such products are described for example in German Patent No. 1,133,735. These surface-active esterification products of higher molecular polyglycols and carboxylic acids may be used, if desired together with known water-soluble thickeners as thickening agents.

As dispersing agents there are considered oxethylation products of phenol, alkyl- and halogen-substituted phenols, naphthols and fatty alcohols having 8 to 18 carbon atoms. The degree of oxethylation is, on an average, between 2 and 25 units of ethylene oxide per hydroxyl group.

All these auxiliaries mentioned may be used individually or in mixture with one another. The amount of these auxiliaries in the printing paste or padding liquor is between 5 and 75 g, preferably 5 to 30 g per kg of printing paste or padding liquor.

After applying the printing pastes or padding liquors on the fibre material the material is heated. It is advantageously dried before heating, for example at room temperature or by heating to a temperature below 100°C, at which no fixation occurs. The two types of dyestuff are fixed only by a heat treatment at higher temperatures in hot air or hot steam at atmospheric pressure.

The duration of this heat treatment is about 20 to 180 seconds in the case of hot air and about 3 to 20 minutes in the case of hot steam. At lower temperatures longer fixation times are necessary for fixation than in the case of higher temperatures. Fixation is preferably effected for 6 to 8 minutes at 180°– 190°C in hot steam or for 45 to 90 seconds at 190° to 210°C in hot air.

The printed or impregnated material is completed in usual manner by rinsing, soaping and rinsing once more and drying.

The process of the invention may be applied to textile material consisting of high polymer linear polyesters such as polyethylene terephthalate and native or regenerated cellulose.

The weight ratio between the two fibres may vary within wide limits, for example between 20 and 80 % of cellulose or polyester.

The dyestuffs used in the present process are dispersion dyestuffs and water-soluble reactive dyestuffs. As dispersion dyestuffs there are considered the dyestuffs sufficiently known for the dyeing of fibre materials of linear polyesters, for example those of the series of the azo or anthraquinone dyestuffs.

As reactive dyestuffs there are considered organic dyestuffs which contain at least one group reacting with the cellulose fibre, a preliminary stage therefore or a substituent reacting with the cellulose fibre. As basic substances of the organic dyestuffs there are particularly suitable those of the series of the anthraquinone, azo and phthalocyanine dyestuffs, whereby the azo and phthalocyanine dyestuffs may be free from metal or contain metal. As reactive groups or preliminary stages which form such reactive groups in the alkaline medium, there may be mentioned for example the epoxy group, the ethyleneimide group, the vinyl group in a vinylsulfone group or in the acrylic acid radical, furthermore the β-sulfatoethyl-sulfone group. As reactive substituent there are considered substituents which can be easily split off and leave an electrophile radical; as examples are mentioned halogen atoms in the following ring systems: quinoxaline, pyridazine, triazine, pyrimidine, phtalazine and pyridazone.

The combination of alkali formate and one or several of the textile auxiliaries described above provides on polyester/cellulose mixed fabrics dyeings and prints showing a pure and brilliant shade, a good color intensity and being fast to rubbing and having an excellent fastness to laundry and to perspiration. They generally do not show the turbidity and etiolating effects which otherwise appear by heat treatments at elevated temperatures in the presence of urea and alkali and which cause a dulling of the dyeing.

A further advantage of the novel process is that the padding liquors and printing pastes are stable and may be prepared, therefore, in stock before printing or padding. It is also possible to dwell the padded or printed material before continuing the process. It may also be overprinted subsequently and the dyed bottom and the overprint may be developed simultaneously.

The following Examples illustrate the invention. Parts and percentages are by weight unless stated otherwise and temperatures are in centigrades.

EXAMPLE 1

A mixed fabric of 67 parts of polyester fibres and 33 parts of cotton was printed with a printing paste having the following composition:

30 Parts of the dispersion dyestuffs of the formula

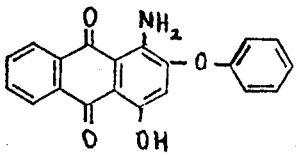

30 Parts of the reactive dyestuff of the formula

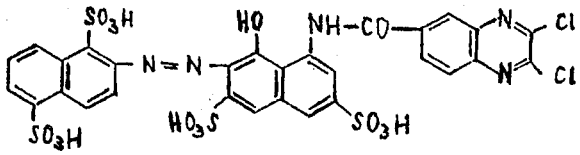

20 Parts of sodium formiate

5 Parts of the compound of the formula $$C_8H_{17}-(O\ CH_2-CH_2)_{15}-OH$$

15 Parts of the compound of the formula

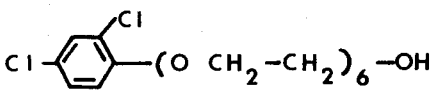

5 Parts of butane-diol-(1,4)-pentaglycol ether-stearic acid ester

600 Parts of alginate thickening (4 % in water)

295 Parts of water

1000 Parts

To fix the dyestuff the fabric was subsequently treated for 90 seconds in hot air at 195°C. Then the material was rinsed hot and soaped with a solution which contained per liter 1.5 g of a non-ionic detergent, rinsed again and dried.

Brilliant even red prints were obtained on both types of fibres.

EXAMPLE 2

A mixed fabric of polyester and spun rayon (mixture ratio of 70 : 30) was printed with a printing paste having the following composition:

30 Parts of the dispersion dyestuff of the formula

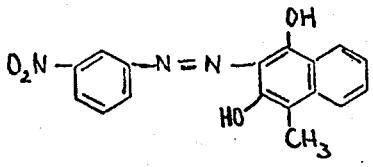

30 Parts of the reactive dyestuff of the formula

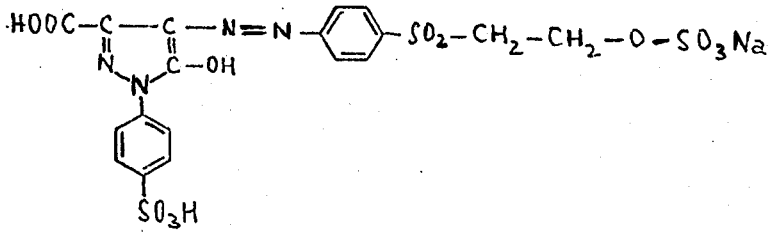

20 Parts of sodium formate

10 Parts of p-phenylphenol

10 Parts of the compound of the formula

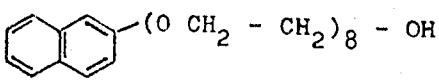

10 Parts of acetyl-succinic acid diethyl ester
600 Parts of alginate thickening (4 % in water)
290 Parts of water
1000 Parts To fix the dyestuff the material was steamed for 8 minutes in hot steam at 180°C.

Then the material was rinsed hot, soaped with a solution which contained per liter 1.5 g of an anion-active detergent, rinsed again and dried. Yellow prints were obtained on both types of fibres.

EXAMPLE 3

A mixed fabric of polyester and spun rayon (mixture ratio 70 : 30) was printed with a printing paste having the following composition:

40 Parts of the dispersion dyestuff of the formula

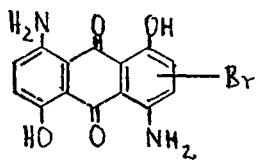

50 Parts of the reactive dyestuff of the formula

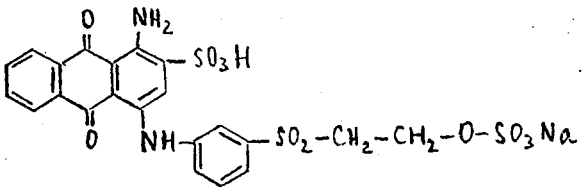

30 Parts of sodium formate
20 Parts of nonyl phenol phenol exethylate having 12 ethylene oxide units
10 Parts of salicylic acid ethyl ester
600 Parts of starch ether thickening (10 % in water)
250 Parts of water
1000 Parts Then the material was dried and treated for 60 seconds with hot air at 200°C. The material was rinsed hot, soaped with a solution which contained per liter 1 g of a non-ionic detergent, soaped again and dried. Blue prints were obtained on both types of fibres.

We claim:

1. A process for the pad-dyeing or printing of textile material consisting of cellulose and polyester fibres with fibre-reactive and dispersion dyestuffs which comprises printing or padding the textile material with a printing paste or padding liquor which contains besides the usual printing auxiliaries and the dyestuffs mentioned an alkali salt of formic acid as well as carriers, levelling and/or dispersing agents, fixing the dyestuffs by dry heat at temperatures above 150°C or by hot steam at temperatures above 140°C, and completing the prints or pad dyeings in usual manner.

2. The process as claimed in claim 1, wherein the sodium salt of formic acid is used.

* * * * *